US011220981B1

(12) United States Patent
Lee

(10) Patent No.: US 11,220,981 B1
(45) Date of Patent: Jan. 11, 2022

(54) METHOD AND DEVICE FOR PREVENTING FOULING OF EXHAUST GAS RECIRCULATION COOLER OF ENGINE

(71) Applicants: HYUNDAI MOTOR COMPANY, Seoul (KR); KIA CORPORATION, Seoul (KR)

(72) Inventor: Dong Bok Lee, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/354,174

(22) Filed: Jun. 22, 2021

(30) Foreign Application Priority Data

Dec. 8, 2020 (KR) ..... 10-2020-0170370

(51) Int. Cl.
*F02M 26/50* (2016.01)
*F02M 26/30* (2016.01)

(52) U.S. Cl.
CPC ..... *F02M 26/50* (2016.02); *F02M 26/30* (2016.02)

(58) Field of Classification Search
CPC ..... F02M 26/50; F02M 26/30
See application file for complete search history.

(56) References Cited

U.S. PATENT DOCUMENTS

2013/0213350 A1* 8/2013 Watanabe ..... F02D 23/00 123/327
2014/0130483 A1* 5/2014 Miyake ..... F01N 3/208 60/285
2014/0227137 A1* 8/2014 Iida ..... B01D 53/9418 422/111
2016/0076470 A1* 3/2016 Takamiya ..... F02D 41/0002 123/676
2021/0301690 A1* 9/2021 Martz ..... F02B 37/22

* cited by examiner

*Primary Examiner* — Xiao En Mo
(74) *Attorney, Agent, or Firm* — McDonnell Boehnen Hulbert & Berghoff LLP

(57) ABSTRACT

Disclosed is a method of preventing fouling of an exhaust gas recirculation (EGR) cooler of an engine including after a vehicle including the engine reaches a reference mileage, operating, by a controller, an exhaust brake device of the vehicle and blocking the discharge of exhaust gas of the engine, after the exhaust brake device is operated, closing, by the controller, an EGR valve that provides the exhaust gas of the engine to an EGR cooler of an EGR system of the engine, and before the operation of the exhaust brake device is stopped, removing, by the controller, a deposition layer generated in the EGR cooler, by opening the EGR valve.

6 Claims, 3 Drawing Sheets

METHOD AND DEVICE FOR PREVENTING FOULING OF EXHAUST GAS RECIRCULATION COOLER OF ENGINE

CROSS REFERENCE TO RELATED APPLICATIONS

This application claims priority to and the benefit of Korean Patent Application No. 10-2020-0170370 filed in the Korean Intellectual Property Office on Dec. 8, 2020, the entire contents of which are incorporated herein by reference.

BACKGROUND

(a) Field

The present disclosure relates to a vehicle, and more particularly, to a method and device for preventing fouling of an exhaust gas recirculation (EGR) cooler of an engine.

(b) Description of the Related Art

In general, most of the vehicle systems, particularly, diesel vehicles, employ an Exhaust Gas Circulation (EGR) device having a function of reducing nitrogen oxides (NOx) in exhaust gas generated by engine driving.

In general, the EGR device is configured such that an EGR valve is mounted in the middle of a pipe that connects an exhaust manifold and an intake manifold, and the amount of EGR is determined by the opening area of the EGR valve, that is, the opening degree according to the opening/closing thereof.

In general, the exhaust gas of the engine includes a large amount of harmful components, such as CO, HC, and nitrogen compounds (NOx). Particularly, when a combustion temperature of the engine rises, the amount of NOx generated increases. Thus, in order to reduce the amount of NOx in the exhaust gas, it is necessary to lower the combustion temperature of the engine.

The main reason among the reasons for the rise in the combustion temperature is instantaneous high-temperature heat which is generated as the propagation speed of flame ignited by an ignition plug increases in the state where the density of a mixer in a combustion chamber is high.

Examples of a method of lowering a combustion temperature of an engine in order to reduce the amount of NOx in exhaust gas includes an EGR method that lowers the combustion temperature of the engine by decreasing the density of a mixer without changing an air-fuel ratio of the mixer itself by including a part of exhaust gas in an intake mixer and introducing the exhaust gas to a combustion chamber.

The EGR method is used not only to reduce the amount of NOx in the exhaust gas, but also to improve fuel efficiency of the engine. When the EGR method is used, the amount of NOx may be decreased by lowering the temperature of the combustion chamber and the ignition timing may be advanced while avoiding a knocking generation area. Accordingly, it is possible to improve an output of the engine and improve fuel efficiency.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a method and device for preventing fouling of an exhaust gas recirculation (EGR) cooler for an engine, which are capable of preventing fouling of an EGR cooler of an EGR system due to the use of the EGR system. An exemplary embodiment of the present disclosure provides a method of preventing fouling of an exhaust gas recirculation (EGR) cooler of an engine including after a vehicle including the engine reaches a reference mileage, operating, by a controller, an exhaust brake device of the vehicle and blocking the discharge of exhaust gas of the engine, after the exhaust brake device is operated, closing, by the controller, an EGR valve that provides the exhaust gas of the engine to an EGR cooler of an EGR system of the engine, and before the operation of the exhaust brake device is stopped, removing, by the controller, a deposition layer generated in the EGR cooler, by opening the EGR valve.

The method may further include determining, by the controller, whether the vehicle reaches the reference mileage for starting control for preventing fouling of the EGR cooler, by using an output signal of a mileage sensor of the vehicle.

The exhaust brake device may include a valve, and the valve may be closed when the exhaust brake device is operated.

Another exemplary embodiment of the present disclosure provides a device for preventing fouling of an exhaust gas recirculation (EGR) cooler of an engine including an exhaust brake device which is used for braking of a vehicle including the engine and decreases revolutions per minute of the engine, and a controller which blocks the discharge of exhaust gas of the engine by operating the exhaust brake device after the vehicle reaches a reference mileage, in which after the exhaust brake device is operated, the controller closes an EGR valve that provides the exhaust gas of the engine to an EGR cooler of an EGR system of the engine, and before the operation of the exhaust brake device is stopped, the controller opens the EGR valve and removes a deposition layer generated in the EGR cooler.

The controller may determine whether the vehicle reaches the reference mileage for starting control for preventing fouling of the EGR cooler, by using an output signal of a mileage sensor of the vehicle.

The exhaust brake device may include a valve, and the valve may be closed when the exhaust brake device is operated.

The method and device for preventing fouling of an EGR cooler of an engine according to the exemplary embodiments of the present disclosure may prevent fouling of the EGR cooler of the EGR system due to the use of the EGR system by using the exhaust brake device. Accordingly, it is possible to secure reliability of the engine of the vehicle.

BRIEF DESCRIPTION OF THE FIGURES

In order to help more full understanding of the drawings used in the detailed description of the present disclosure, a brief description of each drawing is provided.

DETAILED DESCRIPTION

Figure 1:
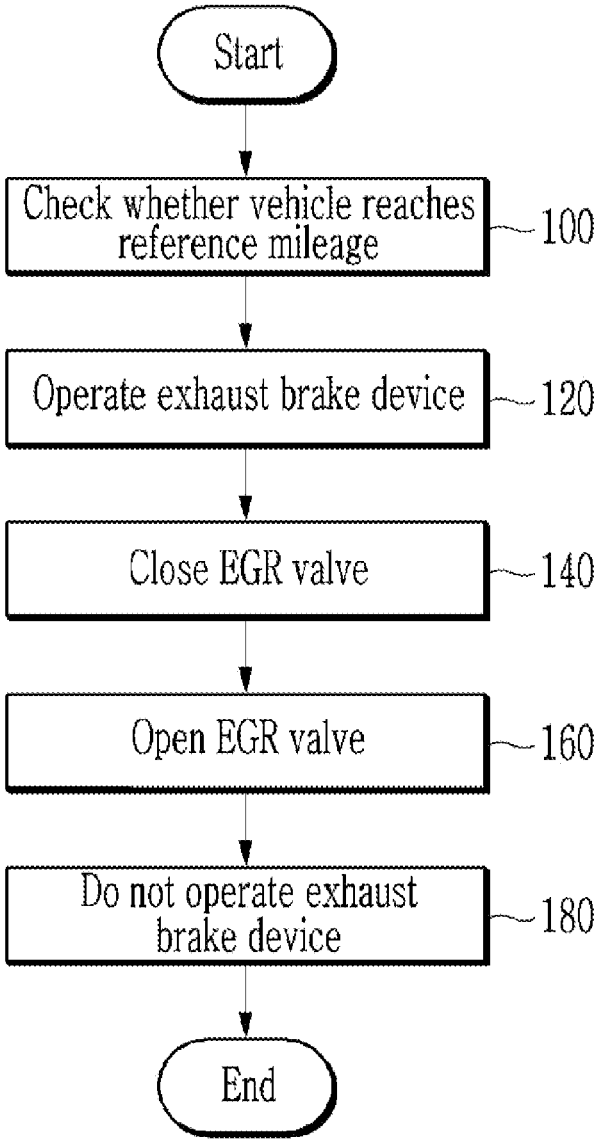
FIG. 1 is a flowchart for describing a method of preventing fouling of an exhaust gas recirculation (EGR) cooler of an engine included in a vehicle according to an exemplary embodiment of the present disclosure.

In order to fully understand the present disclosure and the object achieved by carrying out the present disclosure, reference should be made to the accompanying drawings illustrating an exemplary embodiment of the present disclosure and the contents disclosed in the accompanying drawings.

Hereinafter, the present disclosure will be described in detail by describing the exemplary embodiment of the present disclosure with reference to the accompanying drawings. In the following description of the exemplary embodiment, a detailed description of known configurations or functions incorporated herein will be omitted when it is judged that the detailed description may make the subject matter of the present disclosure unclear. Like reference numerals presented in each drawing designate like elements throughout the specification.

The term used in the present specification is simply used for describing a specific embodiment and does not intend to limit the present disclosure. A singular expression includes a plural expression unless it is specifically described to the contrary in the context. In the present specification, it should be appreciated that terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance.

Throughout this specification, when it is described that an element is "coupled" to another element, the element may be "directly coupled" to the another element or "electrically coupled" to the another element a still another element interposed therebetween.

All terms used herein including technical or scientific terms have the same meanings as meanings which are generally understood by those skilled in the art to which the present disclosure pertains unless they are differently defined. Terms defined in generally used dictionary shall be construed to have meanings matching those in the context of a related art, and shall not be construed as ideal or excessively formal meanings unless they are clearly defined in the present application.

In a method of controlling an exhaust gas recirculation (EGR) system of an engine according to a related technology, in order to prevent fouling of an EGR cooler of the EGR system generated when a temperature of a coolant of the engine is low and a temperature of exhaust gas of the engine is low, it is possible to close an EGR valve which supplies exhaust gas to the EGR cooler of the EGR system.

Figure 2:
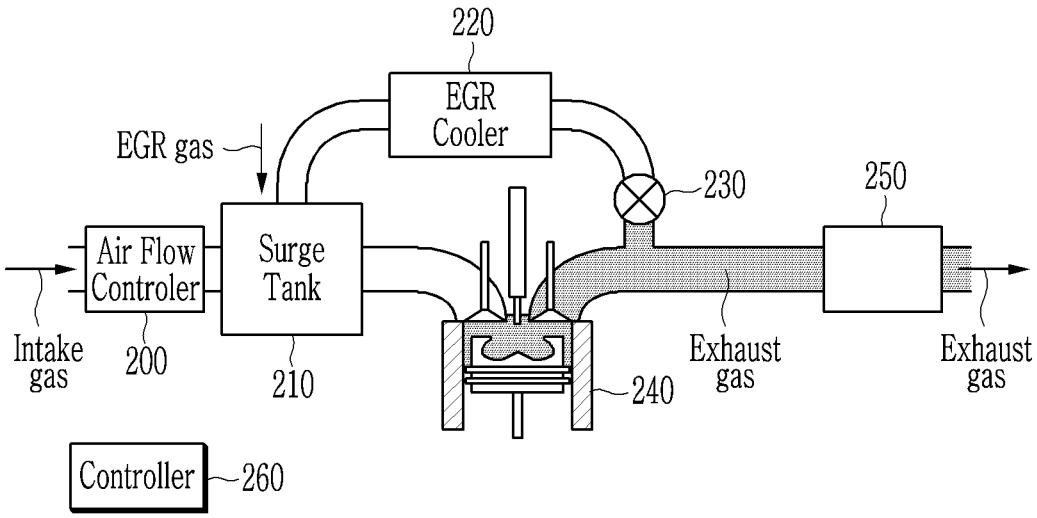
FIG. 2 is a diagram describing an EGR system (or an EGR device) to which the method of preventing fouling of an EGR cooler of an engine illustrated in FIG. 1 is applied.
Figure 3:
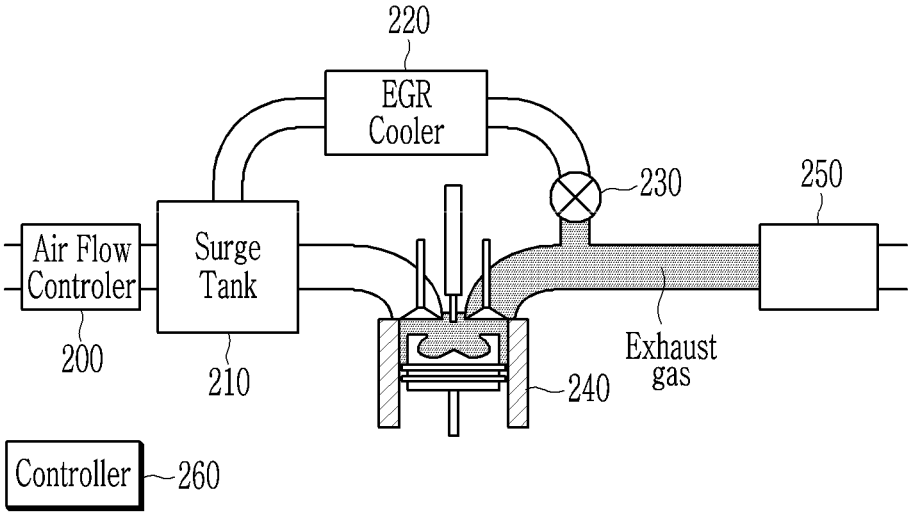
FIG. 3 is a diagram illustrating an exemplary embodiment of an operation of the EGR system illustrated in FIG. 2.
Figure 4:
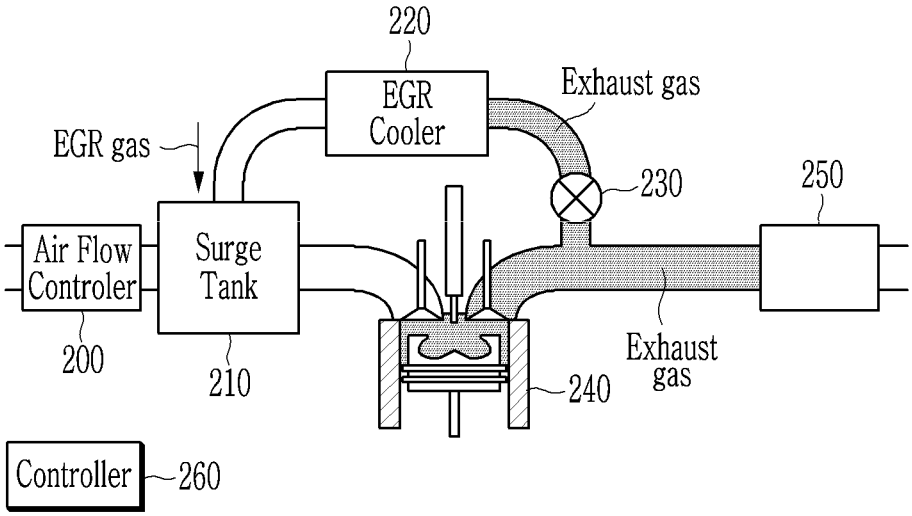
FIG. 4 is a diagram illustrating another exemplary embodiment of an operation of the EGR system illustrated in FIG. 2.

FIG. 1 is a flowchart for describing a method of preventing fouling of an exhaust gas recirculation (EGR) cooler of an engine included in a vehicle according to an exemplary embodiment of the present disclosure. FIG. 2 is a diagram describing an EGR system (or an EGR device) to which the method of preventing fouling of an EGR cooler of an engine illustrated in FIG. 1 is applied. FIG. 3 is a diagram illustrating an exemplary embodiment of an operation of the EGR system illustrated in FIG. 2. FIG. 4 is a diagram illustrating another exemplary embodiment of an operation of the EGR system illustrated in FIG. 2.

Referring to FIGS. 1 to 4, in an operation 100, a controller 260 included in a vehicle may check or determine whether the vehicle reaches a reference mileage for starting control for preventing fouling of an EGR cooler 220, by using an output signal of a mileage sensor of the vehicle. The reference mileage may be determined by a test (or an experiment).

As illustrated in FIG. 2, the vehicle may include an air flow controller 200, a surge tank 210, the EGR cooler 220, an EGR valve 230, an engine 240, an exhaust brake device 250, and a controller 260. The device for preventing fouling of the EGR cooler of the engine may include the EGR cooler 220, the EGR valve 230, the engine 240, the exhaust brake device 250, and the controller 260.

When the EGR valve 230, which adjusts the amount of exhaust gas supplied to the EGR cooler 220, is opened, EGR gas cooled by the EGR cooler 220 of the EGR system illustrated in FIG. 2 is introduced into a combustion chamber of the engine 240 to lower a temperature of the combustion chamber. When the EGR valve 230 is operated, the EGR valve may be opened. The EGR system may advance the ignition timing by suppressing a knocking occurring area of the engine 240. Accordingly, torque of the engine 240 may be improved and fuel efficiency of the vehicle may be improved.

When the EGR gas is supplied to the engine 240, intake gas (or intake air) may be supplied to the engine 240 through the air flow controller 200 and the surge tank 210.

The controller 260 may control the overall operation of the vehicle as an Electronic Control Unit (ECU). The controller 260 may be, for example, one or more microprocessors operating by a program (control logic) or hardware (for example, a microcomputer) including the microprocessor, and the program may include a series of instructions for performing the method of preventing fouling of an EGR cooler of an engine according to the exemplary embodiment of the present disclosure. The instruction may be stored in a memory of the vehicle or the controller 260.

For example, the engine 240 may be a diesel engine. The engine 240 may include an injector for injecting fuel, an intake valve, and an exhaust valve.

The exhaust brake device 250 may be a device which decreases revolutions per minute (RPM) of the engine 240 by blocking the discharge or flow of exhaust gas to the rear end of an exhaust line in order to efficiently operate an engine brake for braking the vehicle. The exhaust brake device 250 may assist a foot brake that is a main brake device. The exhaust brake device 250 may include a valve.

According to an operation 120 illustrated in FIG. 1, as illustrated in FIG. 3, after the vehicle reaches the reference mileage, the controller 260 may block the discharge of the exhaust gas of the engine 240 by operating the exhaust brake device 250 in response to a vehicle braking request of a driver of the vehicle. When the exhaust brake device 250 is operated, the valve of the exhaust brake device may be closed.

According to an operation 140, as illustrated in FIG. 3, in order that a pressure inside the exhaust line (or an exhaust pipe) installed in or connected to the front end of the exhaust brake device is increased after the exhaust brake device 250 is operated, the controller 260 may close the EGR valve 230 that provides the exhaust gas of the engine 240 to the EGR cooler 220 of the EGR system of the engine.

According to an operation 160, as illustrated in FIG. 4, before the operation of the exhaust brake device is stopped (or terminated), the controller 260 may remove a deposition layer generated in the EGR cooler 220 (or a pipe of the EGR cooler), by opening the EGR valve 230. When the EGR valve 230 is opened, high-pressure exhaust gas generated in the exhaust line installed at the front end of the exhaust brake device 250 may remove the deposition layer generated in the EGR cooler 220. The deposition layer may include soot and hydrocarbon (HC).

According to an operation 180, the controller 260 may not operate (or may inactivate) the exhaust brake device 250 in response to a vehicle braking termination request of the driver of the vehicle. When the exhaust brake device 250 is not operated, the valve of the exhaust brake device may be opened.

As described above, the method and device for preventing fouling of an EGR cooler of an engine included in a vehicle according to the exemplary embodiment of the present disclosure may allow high-pressure or high-speed exhaust gas, generated when the exhaust brake device 250 is operated, to flow into the EGR cooler 220, thereby generating turbulence in the EGR cooler. As a result, the turbulence removes the deposition layer of the EGR cooler 220, which makes it possible to prevent fouling of the EGR cooler of the EGR system due to the use of the EGR system.

The constituent element, " . . . unit", a block, or a module used in the exemplary embodiment of the present disclosure may be implemented by software, such as a task, class, subroutine, process, object, execution thread, and program performed in a predetermined area of a memory, or hardware, such as field-programmable gate array (FPGA) or an application-specific integrated circuit (ASIC), and may also be implemented by a combination of the software and the hardware. The constituent element, " . . . unit" or the like may also be included in a computer readable storage medium, and a part thereof may be distributed in the plurality of computers.

As described above, the exemplary embodiments have been disclosed in the drawings and the specification. The specific terms used herein are for purposes of illustration, but are only used for the purpose of describing the present disclosure, and are not used to limit the meaning or the scope of the present disclosure described in the claims. Accordingly, those skilled in the art will appreciate that various modifications and equivalent embodiments may be made without departing from the scope and spirit of the present disclosure. Therefore, the true technical protection scope of the present disclosure will be defined by the technical spirit of the accompanying claims.

The invention claimed is:

1. A method of preventing fouling of an exhaust gas recirculation (EGR) cooler of an engine, the method comprising:

after a vehicle having an engine reaches a reference mileage, operating, by a controller, an exhaust brake device of the vehicle, and blocking discharge of exhaust gas of the engine;

after the exhaust brake device is operated, closing, by the controller, an EGR valve that provides the exhaust gas of the engine to an EGR cooler of an EGR system of the engine; and before the operation of the exhaust brake device is stopped, removing, by the controller, a deposition layer generated in the EGR cooler, by opening the EGR valve.

2. The method of claim 1, further comprising:

determining, by the controller, whether the vehicle reaches the reference mileage for starting control for preventing fouling of the EGR cooler, by using an output signal of a mileage sensor of the vehicle.

3. The method of claim 1, wherein the exhaust brake device includes a valve, and the valve is closed when the exhaust brake device is operated.

4. A device for preventing fouling of an exhaust gas recirculation (EGR) cooler of an engine, the device comprising:

an exhaust brake device configured to brake a vehicle having an engine, and configured to decrease revolutions per minute of the engine; and a controller configured to block discharge of exhaust gas of the engine by operating the exhaust brake device after the vehicle reaches a reference mileage;

wherein after the exhaust brake device is operated, the controller closes an EGR valve that provides the exhaust gas of the engine to an EGR cooler of an EGR system of the engine; and before the operation of the exhaust brake device is stopped, the controller opens the EGR valve and removes a deposition layer generated in the EGR cooler.

5. The device of claim 4, wherein the controller determines whether the vehicle reaches the reference mileage for starting control for preventing fouling of the EGR cooler by using an output signal of a mileage sensor of the vehicle.

6. The device of claim 4, wherein the exhaust brake device includes a valve, and the valve is closed when the exhaust brake device is operated.

* * * * *